US005690092A

United States Patent [19]

Ogyu

[11] Patent Number: 5,690,092

[45] Date of Patent: Nov. 25, 1997

[54] APPARATUS FOR CUTTING A STONE MEMBER SO AS TO HAVE A CURVED SURFACE

[76] Inventor: Shingo Ogyu, 2-6-13, Yahei, Kawaguchi, Saitama 332, Japan

[21] Appl. No.: 668,231

[22] Filed: Jun. 21, 1996

[51] Int. Cl.[6] ..... B28D 1/08

[52] U.S. Cl. ..... 125/21; 451/6

[58] Field of Search ..... 125/21; 451/6, 451/296; 83/788, 789

[56] References Cited

U.S. PATENT DOCUMENTS

| | | | |
|---|---|---|---|
| 1,043,433 | 11/1912 | Jackson | 125/21 |
| 2,795,222 | 6/1957 | Garrison | 125/21 |
| 4,566,424 | 1/1986 | Roujon | 125/21 |
| 5,303,689 | 4/1994 | Mayer | 125/21 |

*Primary Examiner*—Robert A. Rose
*Attorney, Agent, or Firm*—Oblon, Spivak, McClelland, Maier & Neustadt, P.C.

[57] ABSTRACT

An apparatus for cutting a stone member so as to have a curved surface, the apparatus including an endless wire saw disposed horizontally and driven by an electric motor. The saw has a plurality cutting parts including diamond powder cutting parts and is able to be moved vertically by an electric motor. A carriage for supporting and feeding a stone member is provided so as to be moved in the cross direction underneath of the wire saw by an electric motor. The apparatus includes optical follow device having a table which is movable in one direction for positioning thereon a model member, an optical sensor which is being able to follow to the contour of the model member and attached to a movable member which is able to be moved in a orthogonal direction with respect to the moving direction of the table along a guide member disposed in a prescribed position, wherein the moving length of the wire saw in vertical direction being a prescribed ratio with respect to a moving length of the optical sensor, and the moving length of the carriage has a prescribed ratio with respect to the moving length of the table.

9 Claims, 3 Drawing Sheets

APPARATUS FOR CUTTING A STONE MEMBER SO AS TO HAVE A CURVED SURFACE

BACKGROUND OF THE INVENTION

1. Field of the Invention

This invention relates to an apparatus for cutting a stone member so as to have a curved surface by an endless wire saw which has many cutting parts including a diamond powder cutting part.

2. Background of the Invention

In the prior art for cutting a stone member so as to have a curved surface, a numeric controlling method by a computer has been used. Another method has been used, which uses optical contouring equipment with an optical sensor and several pulse motors controlled by electric signals through a numeric control computer and pulse motors, with the result the prices of these machines were considerably expensive.

SUMMARY OF THE INVENTION

Accordingly, it is an object of the present invention to provide an apparatus for cutting a stone member so as to have a curved surface by an endless wire saw and an optical following device without the use of a computer nor pulse motors and which has a mechanically simple inexpensive structure for easy operation.

This invention also provides an apparatus for cutting a stone member so as to have a curved surface including an endless wire saw disposed horizontally and driven by an electric motor and having many cutting parts including a diamond powder cutting part and being able to be moved vertically by an electric motor, and a carriage for supporting a stone member and being able to be moved in the cross direction underneath of the wire saw by an electric motor, which comprises an optical follow device having a table being movable in one direction for disposing a model member made of sheet, an optical sensor being able to follow to the contour of the model member attached to a movable member being able to be moved in a cross direction against to the moving direction of the table along a guide member disposed in a prescribed position, wherein the moving length of the wire saw in a vertical direction is a prescribed ratio with respect to a moving length of the optical sensor, and the moving length of the carriage is a prescribed ratio with respect to the moving length of the table.

BRIEF DESCRIPTION OF THE DRAWINGS

Various other objects, features, and attendant advantages of the present invention will be more fully appreciated as the same becomes better understood from the following detailed description when considered in connection with the accompanying drawings and wherein.

DESCRIPTION OF THE PREFERRED EMBODIMENT

Figure 1:
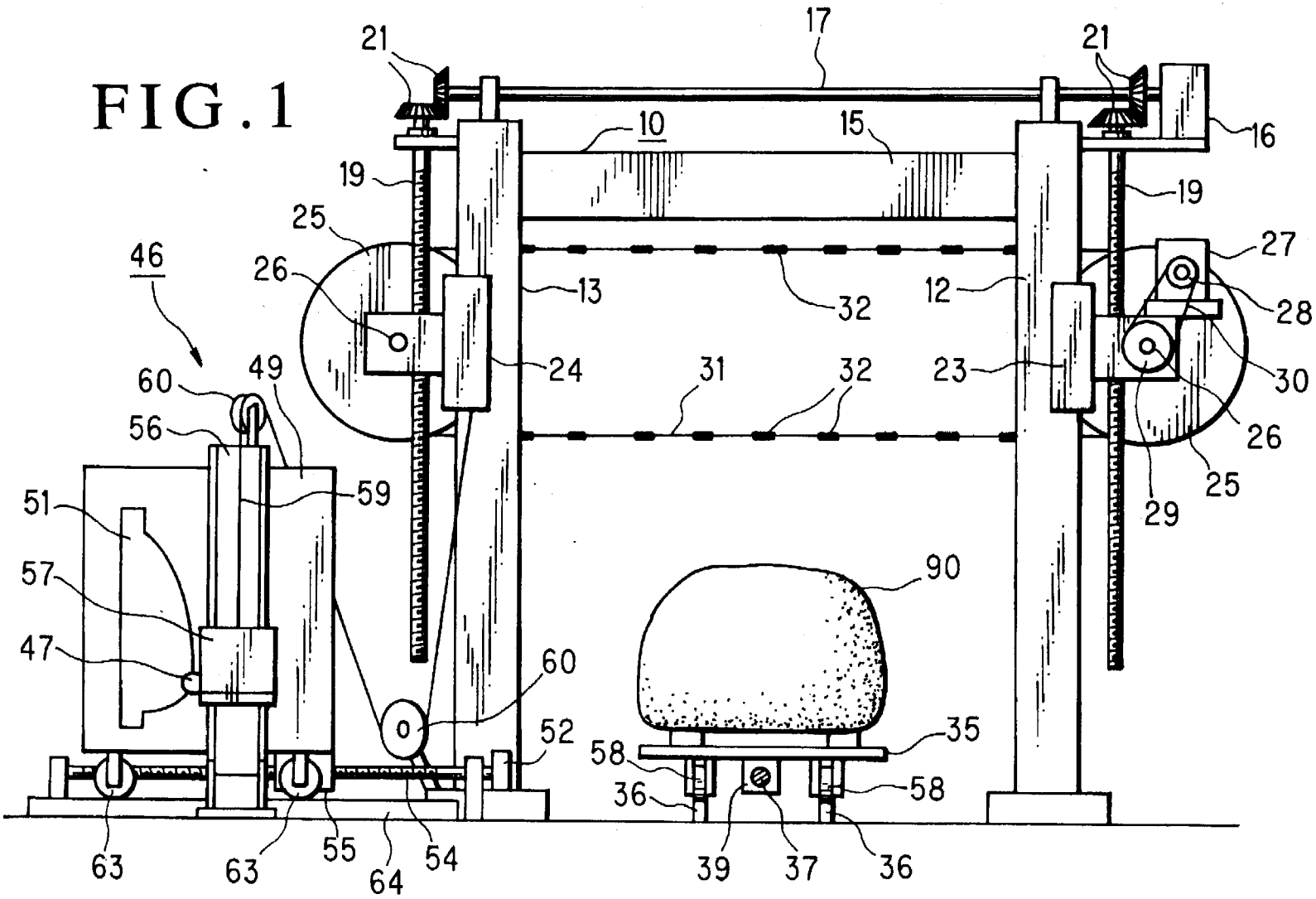
FIG. 1 is a front view of an embodiment of the present invention partly cut away.
Figure 2:
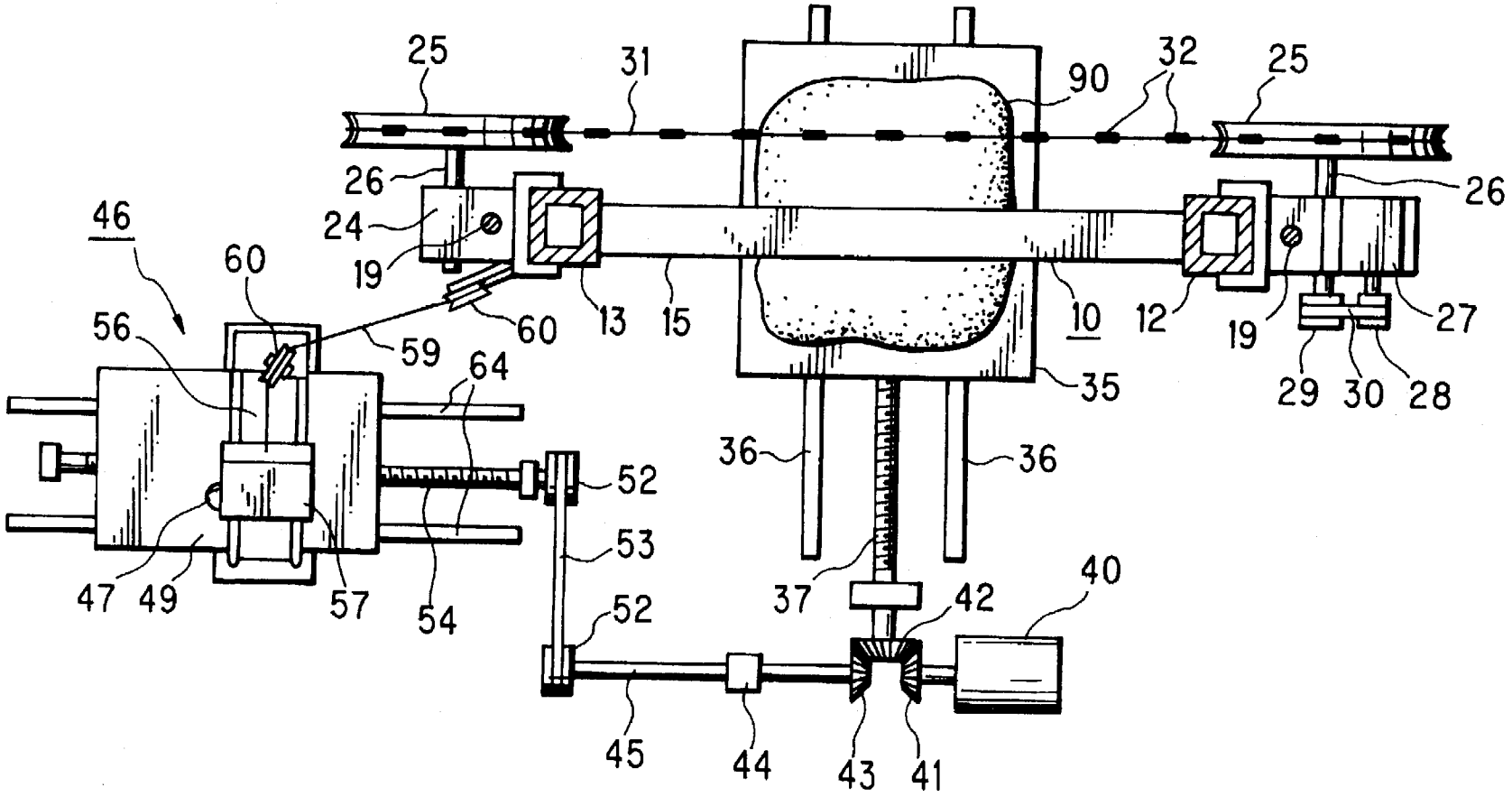
FIG. 2 is a plan view of the embodiment partly cut away.
Figure 3:
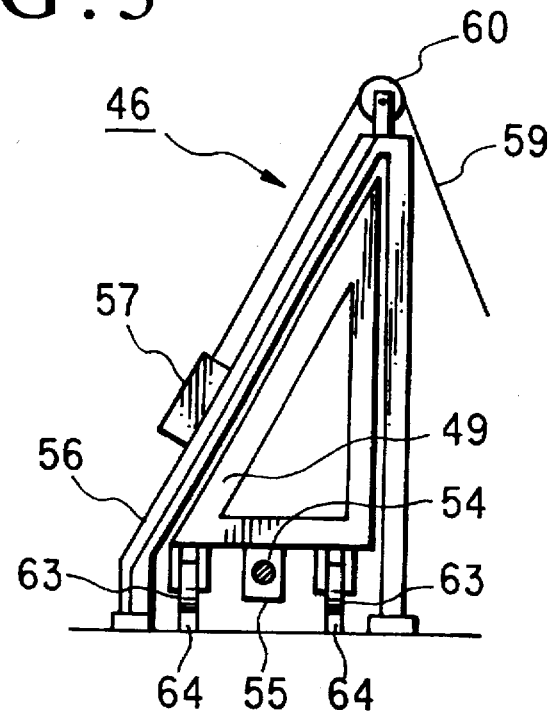
FIG. 3 is a side view of an optical follow device used in the embodiment.

Referring now to FIGS. 1 to 3, there is shown an embodiment of this invention. Reference number 10 designates a main frame which has two side pillars 12 and 13, and a cross bar 15 for connecting the upper part of the pillars. An electric motor 16 is installed on the pillar 12, which is an ordinary induction type and has a brake system wherein the motor is capable of being driven in opposite directions. A horizontal shaft 17 is rotatably supported on the upper portion of the main frame 10 and is driven by the motor 16. A pair of screw shafts 19 are set along the pillars 12 and 13, respectively, and are driven via bevel gears 21 and the shaft 17 of the motor 16 at the same time.

A pair of elevators 23 and 24 are disposed along the pillars 12 and 13 and engaged with the screw shafts 19, respectively. Therefore it is possible to lift or lower the pillars simultaneously. A pair of sheaves 25 are fixed to a pair of shafts 26 rotatably supported by the elevators 23 and 24, respectively. An electric motor 27 mounted on the elevator 23 rotates one of the shafts 26 via pulleys 28, 29 and a belt 30. A wire saw 31 which is made of an endress wire rope and has many cutting parts 32 formed of sintered materials including diamond powder. The wire saw 31 is mounted on the sheaves 25 and continuously driven in one direction by the motor 27.

A carriage 35 for supporting and feeding a stone member 90 is disposed with wheels 58 on a pair of rails 36 so as to pass underneath the wire saw 31. A screw shaft 37 is horizontally elongated and engages with a female screw 39 fixed to the underneath of the carriage 35. A conventional electric motor 40 drives the carriage 35 through two bevel gears 41 and 42 and the screw shaft 37 in both directions and has a brake. Reference number 45 designates a shaft and is driven by the motor 40 through the bevel gears 41, 42 and a bevel gear 43 and clutch 44.

Reference number 46 designates an optical following device having an optical sensor 47, which is sold from Omron Co. Ltd., and has a table 49 slightly inclined condition from a vertical condition thereof for disposing a model member 51 which is made of sheet of material such as paper or the like having a suitable outer configuration. The surface of the table 49 may be a transparent material, in such case the model member 51 may be set along inside surface of the table. The shaft 45 drives a screw shaft 54 through a pair of pulleys 52 and a belt 53. The table 49 has a female screw 55 which engages with the screw shaft 54, and is able to move the same length with the moving length of the carriage 35 by means of wheels 63 on a pair of rails 64. Thus, the moving velocity of the table is the same as the moving velocity of the cartridge 35. The optical sensor 47 is attached to a movable member 57 which is able to be moved vertically along a guide member 56 disposed at fixed position along the surface of the table. The movable member 57 is connected to the elevator 24 with a wire 59 by means of a pair of sheaves 60 which are disposed at appointed positions. Thus the optical sensor 47 is able to move the same length in the downward direction slightly inclined with the downward moving length of the wire saw 31. The wire 59 and sheaves 60 form a velocity transmitting device. Thus, the velocity of the movable member 57 is the same as the downward velocity of the wire saw 31.

Figure 4:
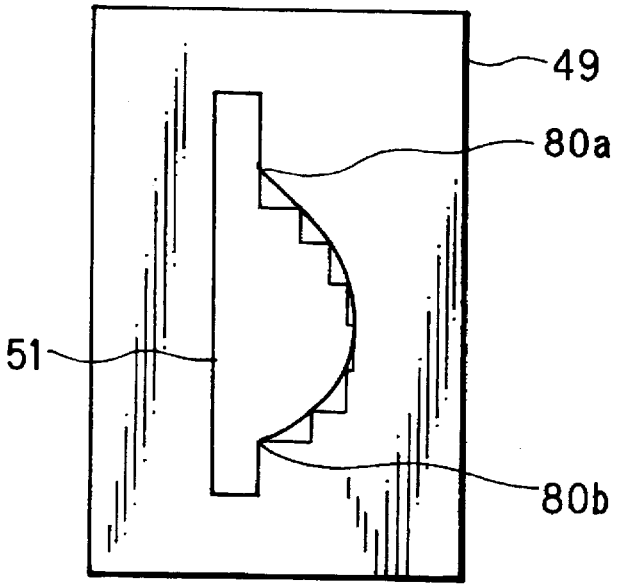
FIG. 4 is a illustrative drawing of the optical follow device.

Referring now to FIG. 4, the activity of the optical follow device 46 will be described as follows. After setting a stone member 90 on the carriage 35, the carriage is to be set at a convenient position for cutting by driving, the electric motor 40 wherein the clutch 44 being disengaged. Then, the wire saw 31 is to be lowered by the motor 16 to the starting point for cutting the stone member 90. The optical sensor 47 is to be set at a point 80*a* on the model member 51. The clutch 44 is to be engaged. The wire saw 31 is to be driven by the motor 27.

The wire saw 31 and the optical sensor 47 are set to generate the downward movement by the motor 16, for example at 0.2 mm per 0.1 second in one step. After the downward movement, the optical sensor 47 emits a signal so as to cause a horizontal movement with respect to the direction of the outline of the model member 51, then the motor 40 drives the carriage 35 and the table 49. The stone member 90 is horizontally cut. When the optical sensor 47 detects the outline of the model member 51, the wire saw 31 and the optical sensor 47 are again driven to move downwardly. Thus, the optical sensor 47 repeats the emission of signals. When the optical sensor 47 has been reached, the last point **80*b* of the outline of the model member 51, the cutting is finished. All of the motors are stopped. The small line in FIG. 4 shows such a phenomenon in a enlarged scale. Therefore, it is easily understood that the optical sensor 47 is able to follow along the outline of the model member 51. Then, the wire saw 31 is elevated by driving the motor 16 in a reverse direction. In the usual case, the stone member 90 is to be properly moved, and the wire saw 31** is to be set at the next cutting point, and these operations are to be repeated.

In the above explanation, the size of the cutting shape of the stone member 90 is corresponds to the size of the model member 51, however, it is possible to use a model member which has ½ size of the cutting portion of the stone member 90 in all direction by utilizing the following method. The end of the wire 59 is not fixed to the movable member 57 and is fixed to the upper part of the guide member 56 through a new sheave (not shown) rotatably supported on the movable member 57. Therefore, the speed of the movable member 57 is ½ of the downward speed of the wire saw 31. For making the speed of the table 49 be ½ carriage 35, the ratio of the pulleys 52 is to be changed to 1:2. In this case, the lowering speed of the optical sensor 47 in one step is set to 0.1 mm per 0.1 second, the stone member 90 is to be cut as the same figure to the above mentioned example of the cutting.

In this invention, it is not always necessary to have the ratio of the downward distance of the wire saw 31 and the moving distance of the optical sensor 47 correspond the ratio of the moving length of the carriage 35 and the moving length of the table 49.

The foregoing is of course considered as illustrative only of the present invention. Obviously, numerous modifications of the present invention are possible in light of the above teaching.

I claim:

1. An apparatus for cutting a stone member so as to have a curved surface, which comprises:

an endless wire saw disposed horizontally and driven by an electric motor and having a plurality of cutting parts including a diamond powder cutting part and being movable vertically by an electric motor, and a carriage supporting and feeding a stone member and being movable in the cross direction underneath said wire saw by an electric motor;

an optical following device having a table movable in one direction for supporting a model member made of sheet of material, and an optical sensor which follows the contour of said model member and is attached to a movable member which is movable in an orthogonal direction with respect to a direction of movement said table along a guide member disposed in a prescribed position, wherein the length of movement of said wire saw in a vertical direction is a prescribed ratio with respect to the length of movement of said optical sensor, and the length of movement said carriage is a prescribed ratio with respect to the length of movement of said table.

2. An apparatus as set forth in claim 1, wherein said apparatus further includes a main free and a pair of elevators which are movable along said main frame, said wire saw is mounted on a pair of sheaves which are rotatably supported on said elevators, respectively.

3. An apparatus as set forth in claim 1, wherein the moving length of said wire saw in the vertical direction is the same as the length of movement of said optical sensor and the length of movement said carriage is the same as the length of movement said table.

4. An apparatus as set forth in claim 1, wherein the length of movement of said optical sensor is ½ of the length of movement said wire saw in the vertical direction and the length of movement said table is ½ of the length of movement said carriage.

5. An apparatus for cutting a stone member so as to have a curved surface, which comprises:

an endless wire saw disposed horizontally and driven by an electric motor and having a plurality of cutting parts including a diamond powder cutting part and being moveable vertically by an electric motor, and a carriage supporting and feeding a stone member and moveable in the cross direction underneath said wire saw by an electric motor;

an optical following device having a table movable in a horizontal and straight direction by said electric motor for driving said carriage with a velocity having a predetermined ratio with respect to the velocity of said carriage for supporting a model member made of a sheet of material, a movable member guided in a perpendicular direction against to the direction of movement of said table by a guide member disposed at a fixed position along the surface of said table and movable by the downward movement of said wire saw by a velocity transmitting device with the velocity having a predetermined ratio with respect to the downward velocity of said wire saw, and an optical sensor attached to said movable member, wherein said optical sensor is movable a prescribed length from a position at a starting position of the outline of said model member in a prescribed time period and said wire saw is downwardly movable a prescribed length in a driven condition thereof from a starting position for simultaneously cutting the stone member, said table being subsequently movable to a position wherein said optical sensor is located on the exterior surface of said model member and said carriage is horizontally moved for simultaneously cutting the stone member, said movements being repeated wherein said optical sensor is located at a final position of the exterior surface of said model.

6. An apparatus as set forth in claim 5, wherein said velocity transmitting device includes a wire and a plurality of sheaves.

7. An apparatus as set forth in claim 5, wherein said apparatus further includes a main frame and a pair of elevators which are moveable along said main frame, and said wire saw is installed along a pair of sheaves which are rotatably supported on said elevators, respectively.

8. An apparatus as set forth in claim 5, wherein the moving length of said wire saw in a vertical direction is the same as the moving length of said optical sensor and the moving length of said carriage is the same as the moving length of said table.

9. An apparatus as set froth in claim 5, wherein the moving length of said optical sensor is ½ the moving length of said wire saw in a vertical direction and the moving length of said table is ½ the moving length of said carriage.

* * * * *